US006435894B2

(12) United States Patent
Little et al.

(10) Patent No.: US 6,435,894 B2
(45) **Date of Patent: *Aug. 20, 2002**

(54) CONNECTOR FOR AIRBAG GAS GENERATOR

(75) Inventors: Philip V. Little, High Wycombe; Stuart L. Kingswell, Mentmore, both of (GB); Martin Leissner, Hessen (DE)

(73) Assignee: Tyco Electronics Logistics AG (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/353,186

(22) Filed: Jul. 14, 1999

Related U.S. Application Data

(60) Provisional application No. 60/092,895, filed on Jul. 15, 1998, provisional application No. 60/121,499, filed on Feb. 24, 1999, and provisional application No. 60/121,650, filed on Feb. 24, 1999.

(51) Int. Cl.[7] ..... H01R 13/627

(52) U.S. Cl. ..... 439/352; 439/188

(58) Field of Search ..... 439/188, 352, 439/358, 488, 489; 200/51.1

(56) References Cited

U.S. PATENT DOCUMENTS

| | | | | |
|---|---|---|---|---|
| 4,786,258 A | | 11/1988 | Shaffer et al. | 439/188 |
| 4,906,203 A | | 3/1990 | Margrave et al. | 439/188 |
| 5,993,230 A | * | 11/1999 | Gauker et al. | 439/352 |

FOREIGN PATENT DOCUMENTS

| | | | |
|---|---|---|---|
| DE | 43 42 651 C2 | | 6/1994 |
| DE | 43 17 344 A1 | | 12/1994 |
| DE | G 93 07 884.6 | | 12/1994 |
| DE | 195 11 410 A1 | | 10/1996 |
| DE | 295 21 491 | | 7/1997 |
| DE | 196 19 323 A1 | | 11/1997 |
| DE | 198 94 599 A1 | | 8/1999 |
| EP | 0 367 070 A2 | | 10/1989 |
| EP | 0 367 173 A1 | | 10/1989 |
| EP | 0 233 397 B1 | | 9/1992 |
| EP | 0 402 654 B1 | | 12/1992 |
| EP | 0 591 947 | | 4/1994 |
| EP | 0 650 229 A2 | | 4/1994 |
| EP | 0 758 806 A1 | | 2/1997 |
| EP | 0 791 987 A2 | | 8/1997 |
| EP | 0 808 749 A2 | | 11/1997 |
| EP | 0 818 853 A2 | | of 1998 |
| EP | 0 889 551 A2 | | 1/1999 |
| EP | 0 902 506 A2 | | 3/1999 |
| EP | 0 921 600 A2 | | 6/1999 |
| GB | 2 297 002 B | | 7/1996 |
| GB | 2 288 555 B | | 8/1997 |
| GB | 2 310 087 | | 8/1997 |
| GB | 2 319 673 A | | 5/1998 |
| GB | 2319673 | * | 5/1998 ..... 439/188 |
| WO | WO 97/04504 | | 2/1997 |
| WO | WO 97/41623 | | 11/1997 |
| WO | WO 98/09355 | | 3/1998 |
| WO | WO 98/43322 | | 10/1998 |
| WO | WO 98/08062 | | 2/1999 |
| WO | WO 99/36293 | | 7/1999 |

* cited by examiner

*Primary Examiner*—Hien Vu
(74) *Attorney, Agent, or Firm*—Hoffmann & Baron, LLP

(57) ABSTRACT

A connector for an automobile airbag gas generator assembly requires only a single operator action to establish both mechanical and electrical engagement with a mating socket connector and two independent operator actions to disengage the connector from the socket connector. An alternate embodiment of the connector present invention requires two independent operator actions to establish both mechanical and electrical engagement with a mating socket connector carrying a deflectable shorting clip and three independent operator actions to disengage from the socket connector. A further embodiment of the connector of the present invention requires two independent operator actions for both establishing and breaking mechanical and electrical engagement with a mating socket. An improved shorting clip design is also provided as well as keying modes for assuring proper mechanical connection.

8 Claims, 17 Drawing Sheets

CONNECTOR FOR AIRBAG GAS GENERATOR

This application claims benefit of Provisional Applications 60/092,895 filed Jul. 15, 1998; 60/121,499 and 60/121,650 both filed Feb. 24, 1999.

FIELD OF THE INVENTION

The present invention relates to the field of electrical connectors. More specifically, the present invention relates to the field of electrical connectors for connecting to the pins of an initiator of an automobile airbag gas generator assembly.

BACKGROUND OF THE INVENTION

Airbag gas generators contain the primary initiation charge for inflating automobile airbags during sufficiently extreme impact environments. A gas generator is an electro-explosive device (EED), or squib, initiated by an electrical signal that is generated by a control device upon sensing impact forces falling within the parameters indicating the need for airbag inflation. Once the squib has received a firing signal from the control device, the explosive gases produced by the squib inflate the airbag quickly. The control system is connected to the airbag by means of a wiring harness which typically includes an electrical plug and socket connector arrangement to permit an easy method of electrically joining the airbag assembly and the control system after they have been separately installed. As the airbag is a critical safety device that is relied upon to help protect occupants of a vehicle in an accident, the integrity of this connector arrangement is of paramount importance.

It is well-known in the airbag gas generator art for the squib to provide a pair of connector lead pins within a female connector housing for insertion into a pair of socket connectors within a male connector housing. It is also well-known in the art to provide a shorting clip for maintaining an electrical short across the connector pins to protect the squib from electro-static discharge prior to installation. The design of male connector components for such known female connector components of airbag gas generator assemblies should therefore incorporate both safety and reliability features for ensuring the timely and proper deployment of the airbag once required.

Towards this end, connector assemblies for airbag gas generators have been developed with a goal of providing a secure and reliable electrical connection for relaying a firing signal to the airbag gas generator during an accident. One typical a connector assembly known in the art is retained in the mated position by means of a fixed rib on the outer surface of the plug connector which cooperatively engages a groove on the interior wall of the socket housing. A drawback of this connection assembly is that it requires the assembly operator to forcibly push the locking piece into place but gives no indication that full engagement has occurred. It is possible the plug connector may not be fully inserted into the socket while still giving the operator an outward appearance of full locking engagement between the components.

Manufacturers seeking to improve the retention of the connector began employing a separate means for positively retaining the plug connector within the socket. An example of a prior art connector employing a positive latching mechanism is shown in U.S. Pat. No. 5,314,345. This three-piece connector incorporates a separate locking element having latching legs for insertion into the mated connector. The reliability of this configuration also suffers due to the possibility that an assembly operator may altogether forget to insert the locking piece into the mated connector or may likewise not fully insert the locking piece into a locking position.

There is therefore a need in the art for an electrical plug connector for the socket component of an airbag gas generator assembly which provides a two-component connection assembly having a positive latching mechanism. The connector should automatically establish locking engagement with a socket without requiring additional effort on the part of the assembly operator. It is also desirable to provide an electrical connection assembly that requires multiple independent operator actions to attain disconnection. Additionally, it is desirable to provide an electrical connection assembly for an airbag gas generator assembly that utilizes a minimum number of parts to ensure reliable assembly of the connector assembly constituent elements. When the socket includes a shorting clip, the assembly should maintain the shorting connection across the leads of the airbag gas generator assembly until after a shielded electrical connection is mechanically ensured with the socket connector. It is then also desirable for the connector to establish a mechanically-locked connection assembly prior to disengaging the shorting connection across the leads. It is also then desirable for a connector to allow electrical shorting while still mechanically locked in place.

SUMMARY OF THE INVENTION

In view of the needs of the art, the present invention provides a connector assembly particularly suited for an automobile airbag gas generator assembly. The present invention provides a plug connector for insertion into a socket connector having a socket connector wall defining a socket cavity and supporting a conductive socket contact in the socket cavity. The plug connector includes an elongate male connector housing and a dependent housing shaft supporting an elongate housing latch deflectable thereto-wards. Deflection of the housing latch permits the housing shaft to be inserted into and withdrawn from the socket cavity. An elongate electrical contact supported in the male connector includes a cable terminating end and an opposed interconnection end extending into the shaft for engagement with the an electrical contact lead or pin supported in the socket. The plug connector also includes a housing cover supporting a depending blocking arm which extends between the latch and the shaft and which is deflectable between a first position preventing deflection of the latch, and a second position permitting deflection of the latch. The cover is spring biased towards the first position.

An alternate embodiment of the present invention provides a connector assembly including a plug connector having a housing supporting a pair of electrical terminals and a cover movably supported in overlying disposition with respect to the housing. The connector assembly also includes a socket connector including a socket body supporting a pair of electrical contacts within a cavity formed in the socket body. The plug connector is insertably removably accommodated by the socket body cavity for establishing electrical connection between the terminals and the contacts. The housing further includes a deflectable latch wherein the plug housing is insertably removable with respect to the socket body cavity upon deflection of the latch. The cover further supports a blocking lug thereon, such that the cover extends towards and away from the housing between a first position placing the blocking lugs clear of the latch and permitting the connector latch to be deflected towards the shaft and to pass through the socket opening, and a second position placing the blocking lug adjacent the connector latch to prevent the latch from deflecting sufficiently to allow passage through the socket cavity.

Yet another embodiment of the present invention provides a connector assembly including a plug connector having a housing supporting a pair of electrical terminals and a cover movably supported in overlying disposition with respect to the housing. The connector assembly also includes a socket connector including a socket body supporting a pair of electrical contacts within a cavity formed in the socket body. The plug connector is insertably removably accommodated by the socket body cavity for establishing electrical connection between the terminals and the contacts. The housing further includes a deflectable latch wherein the plug housing is insertably removable with respect to the socket body cavity upon deflection of the latch. The plug connector also includes a mechanical and electrical assurance button including a locking arm extendable between the latch and the shaft and arming arm extendable between the shorting clip and the shaft. The button is extendable from a first position to a second position. The first position maintains the electrical short across the female socket contacts and allows the latch to be deflected towards the shaft so as to allow the shaft to pass through the socket cavity. The second position disengages the electrical short across the female socket contacts and prevents deflection of the latch so as to prevent the shaft from passing through the socket opening.

The present invention also provides a deflectable shorting clip assembly for an electrical connection. The shorting clip assembly includes a socket housing having a socket housing wall defining a socket cavity and supporting a pair of socket contacts in the socket cavity. The socket contacts define a contact gap therebetween. An elongate shorting clip is provided having a first end supported by the socket housing wall and a second end extending into the contact gap. The second end is deflectable between a first position mutually engaging the pair of socket contacts and a second position spaced from mutual engagement with the pair of socket contacts.

The present invention also provides a keying structure between the shaft of the plug connector and the socket wall to align the socket contacts and the connector contacts prior to establishing electrical connection thereacross.

DETAILED DESCRIPTION OF THE INVENTION

Figure 1:
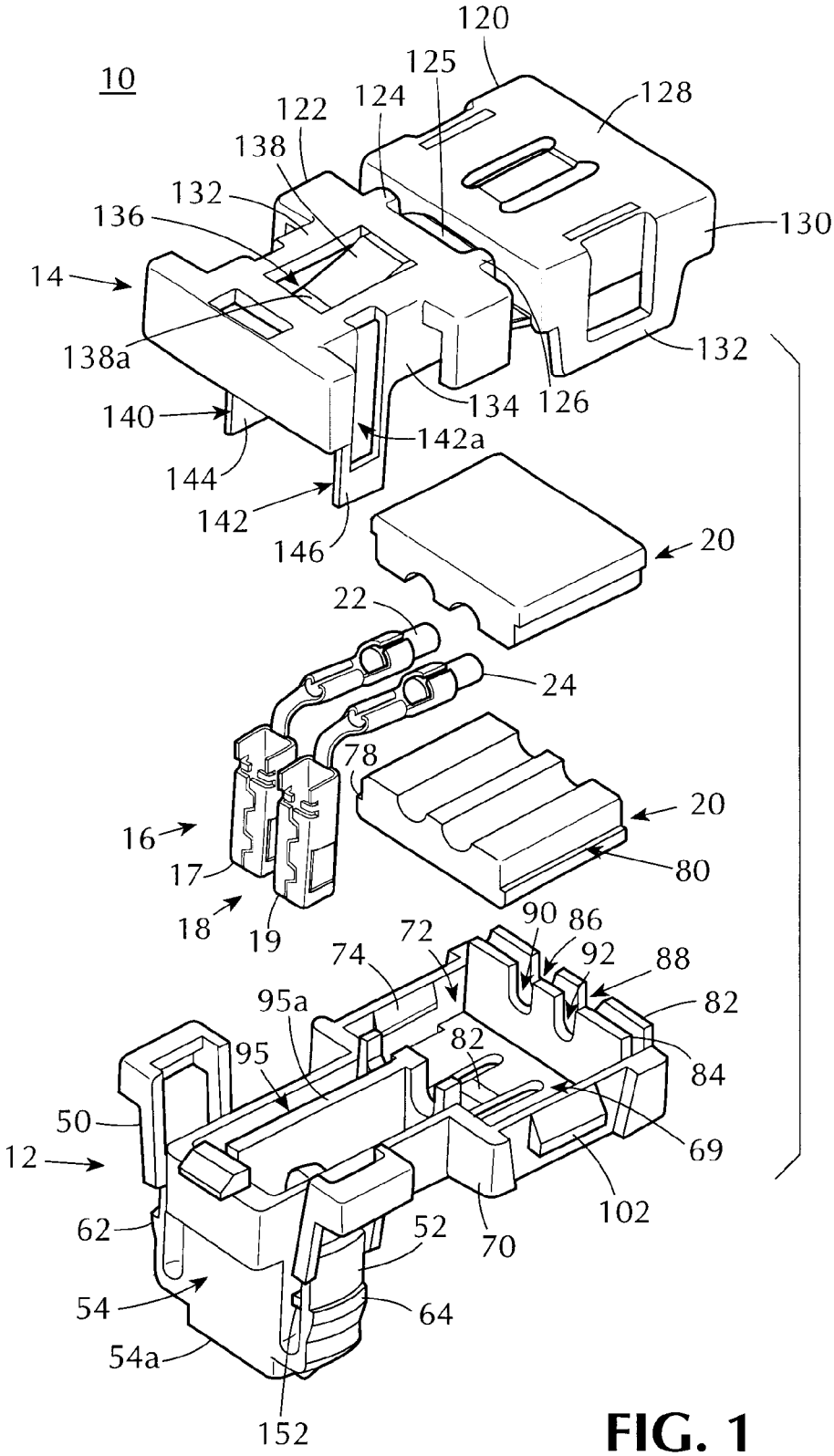
FIG. 1 is exploded view of a plug connector of the present invention.
Figure 2A:
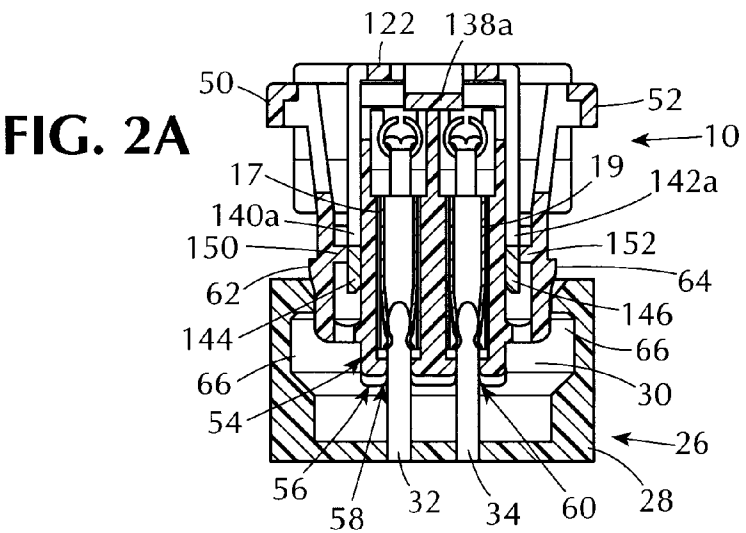
FIGS. 2A–E are sectional views of the mating sequence of the connector of FIG. 1 being inserted to a socket connector.
Figure 2B:
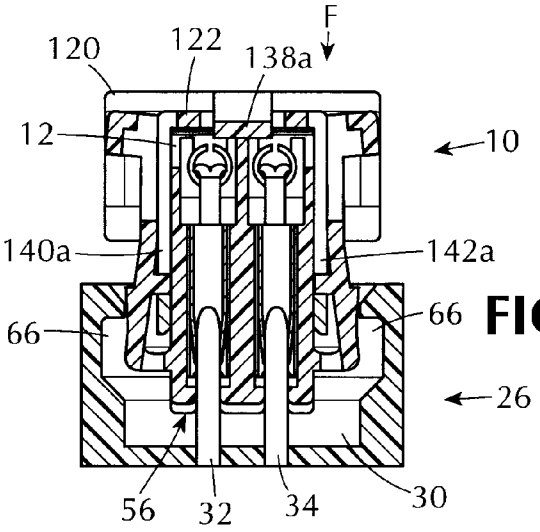
Figure 2C:
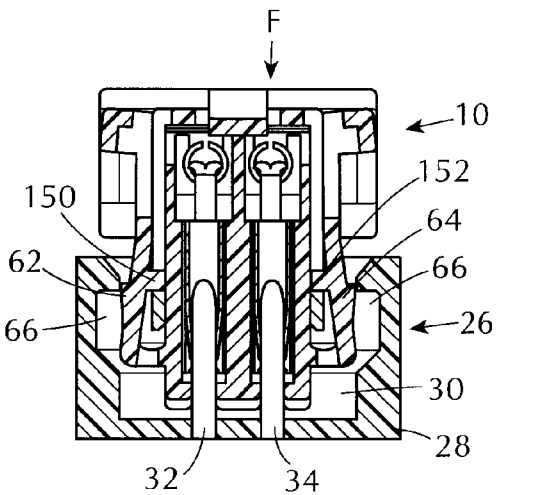
Figure 2D:
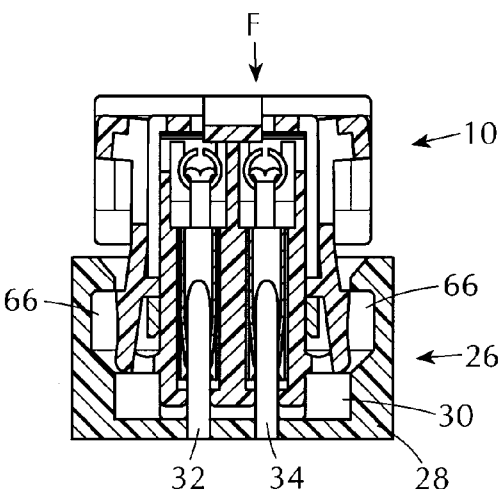
Figure 2E:
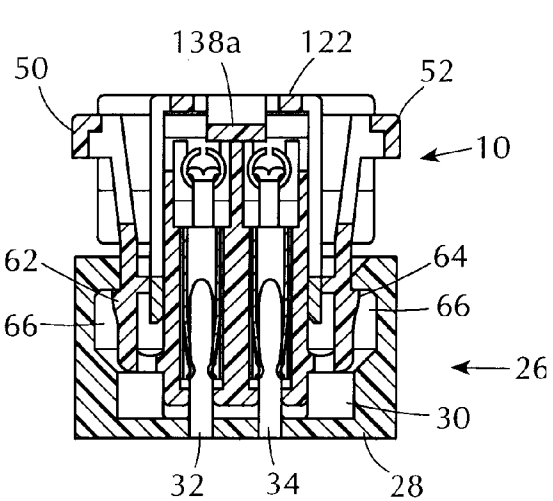
Figure 3:
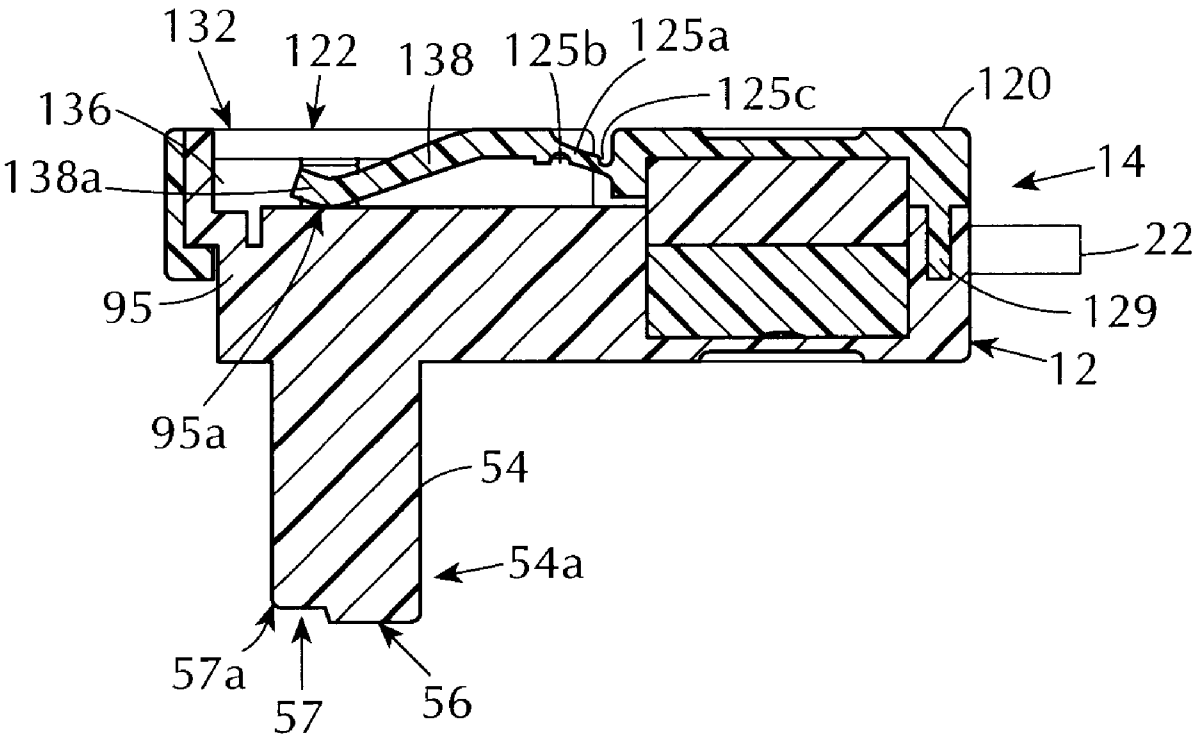
FIG. 3 shows a longitudinal cross-sectional view of the connector of FIG. 1 depicting the cover in an undeflected configuration.
Figure 5:
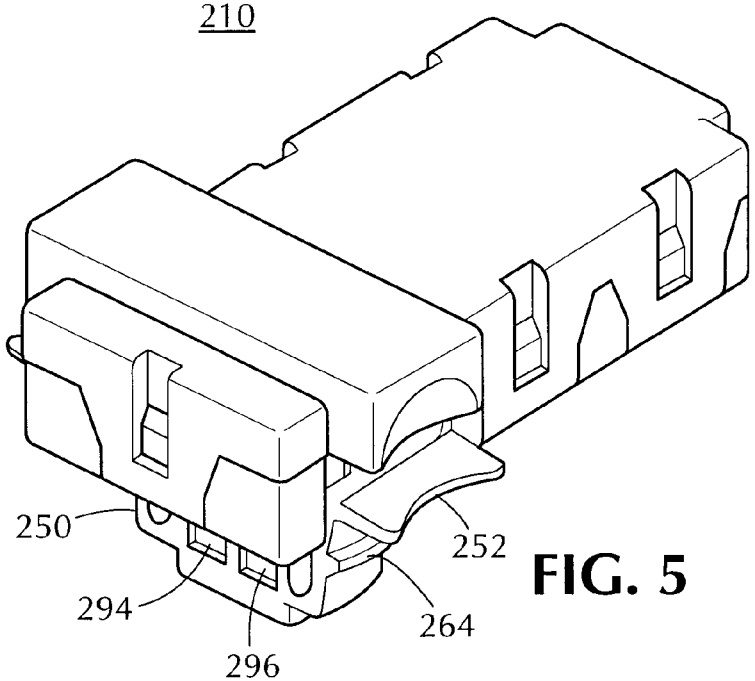
FIG. 5 is an assembly drawing of the plug connector of FIG. 4.
Figure 4:
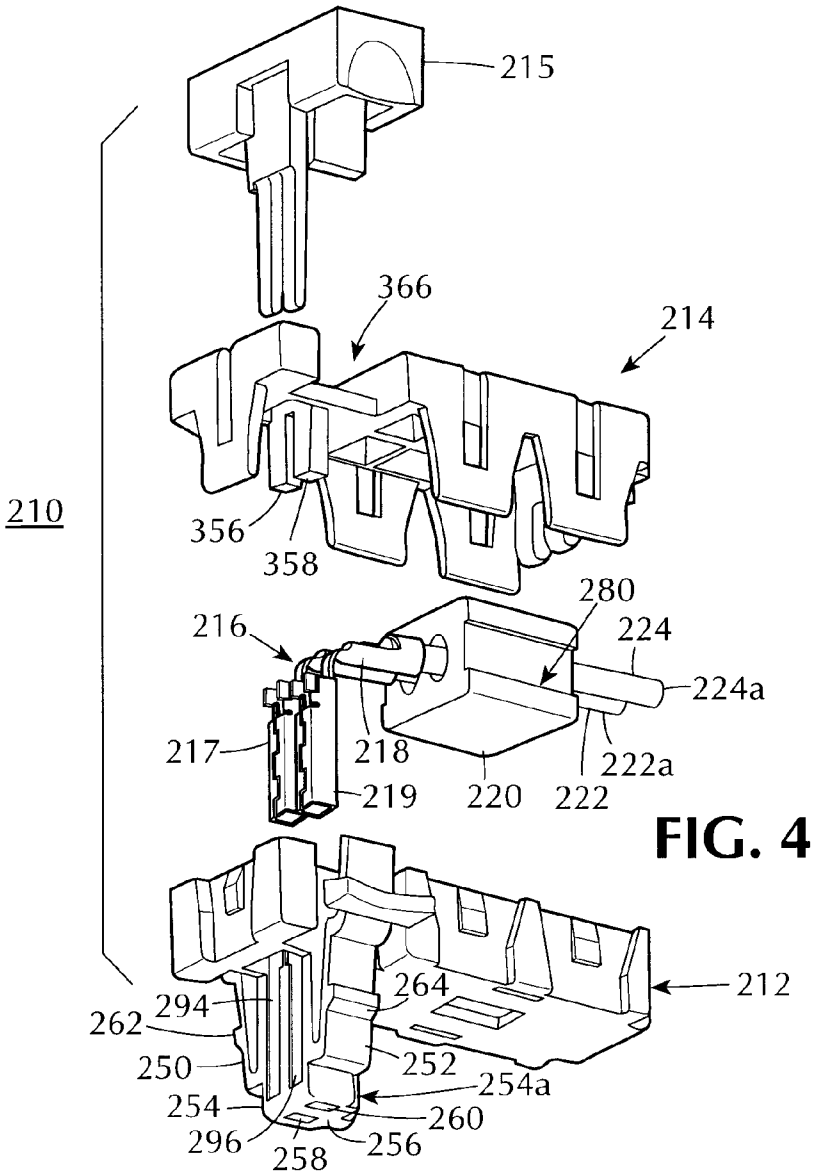
FIG. 4 is an exploded view of another plug connector of the present invention.

Referring to FIGS. 1–3, the present invention provides a plug connector 10 for connecting to a socket connector 26 for establishing an ignition circuit for an automobile airbag gas generator squib (not shown). As will be described hereinbelow, plug connector 10 requires only a single operator action, or insertion force, for establishing a secure mechanical and electrical connection in a connector assembly while also requiring two independent operator actions to electrically and mechanically disconnect from a connector assembly. Plug connector 10 includes a connector housing 12 and a hinged connector cover 14 for fixedly supporting a first and second elongate electrical contact, 16 and 18, and a split ferrite assembly 20. First and second contacts 16 and 18 each terminate at opposed first and second socket contacts 17, 19 and first and second pigtail wires 22, 24, respectively. Pigtail wires 22 and 24 are desirably respectively crimped to contacts 16 and 18 at a location within ferrite assembly 20, although the present invention also contemplates crimping wires 22 and 24 to contacts 16 and 18 at a location transiting or outside of ferrite assembly 20. Housing 12 and cover 14 are formed from a suitable dielectric material.

Connector 10 provides removable mating engagement with a socket connector 26, shown in FIGS. 2A–E, having a socket housing 28 which defines a socket cavity 30. Socket connector 26 supports a first and second socket lead, or pin, 32 and 34 in socket cavity 30 for establishing an electrical circuit with first and second contacts 16 and 18 in connector 10. Socket housing 28 also defines a mating groove 66 communicating with socket cavity 30 for establishing mechanical connection with connector 10. Connector 10 may also include an electrical shorting clip, not shown, for providing deflectable shorting engagement across pins 32 and 34.

Housing 12 includes a pair of cantileverally-deflectable arms 50, 52 extending from the distal end 54*a* of a connecting shaft 54. Shaft 54 terminates at a connector face 56 and is insertable into socket cavity 30 to establish both mechanical and electrical connection between connector 10 and socket 26. Connector face 56 defines a pair of socket apertures 58, 60 positioned in underlying registry with socket contacts 17, 19 so as to enable lead pins 32, 34 to be inserted therethrough and establish electrical connection between the airbag gas generator and the firing circuitry. The outer surfaces of deflectable arms 50, 52 each include a projecting rib 62, 64 thereon for insertion into mating groove 66 of socket housing 28. Deflectable arms also include an interiorly projecting lug 150 and 152 facing shaft 54, for purposes described hereinbelow.

Housing 12 further includes a base wall 69 and a perimetrical housing wall 70 which defines an interior cavity 72. Interior cavity 72 retentatively receives first and second contact elements 16, 18 and ferrite component 20 therein. Housing wall 70 includes a pair of opposed retention clips 74 and 76 (not shown) facing across interior cavity 72 for engaging a pair of oppositely-extending locking ledges 78, 80 formed on ferrite component 20. Bottom wall 69 includes a deflectable protrusion 82 facing interior cavity 72 for retentatively forcing locking ledges 78, 80 of ferrite component 20 against retention clips 74, 76 on housing wall 70. A spring stop wall 95 having a spring stop edge 95*a* is positioned in interior cavity 72 between contacts 16 and 18.

Housing wall 70 further includes a pair of exteriorly-facing detents 100 (not shown) and 102 thereon. Housing 12 further includes a crenelated back wall 82 and a crenelated interior wall 84 spaced parallel thereto. Both crenelated walls 82 and 84 define a pair of adjacent apertures 86, 88, and 90, 92 for receiving wires 22 and 24 therethrough.

Cover 14 includes a fixed cover member 120 and a deflectable cover member 122 deflectably attached to fixed cover member 120 by three hinges 122, 124, and 126. As represented in FIG. 3, the hinges include an elongate substantially rigid hinge link body (124*a* shown), spanning between the cover members 120 and 122 and being connected to each by a narrow living hinge (124*b* and 124*c* shown) to better approximate linear motion for deflectable cover member 122. Fixed cover portion 120 includes a planar top wall 128 and a depending perimetrical wall 130. Deflectable cover member 122 similarly includes a planar top wall 132 and a depending perimetrical wall 134. Perimetrical walls 132 and 134 define a cover cavity 136 positionable in overlying registry with housing interior cavity 72.

Fixed cover member 120 also includes a back crenelated wall, not shown, projecting from top wall 128 which is formed to extend between crenelated walls 82 and 84 of housing 12 and define a pair of pigtail passageways through housing 12. Perimetrical wall 130 further includes a first and second clasp detents 130 (not shown) and 132 formed to cooperatively engage detents 100 and 102 of housing 12 and thereby hold housing 12 and cover 14 together.

Top wall 132 of deflectable cover member 122 includes a centrally-located depending cantilever spring 138 having free end 138*a*. As shown in FIG. 3, spring free end 138*a* abuts spring stop edge 95*a* so as to urge deflectable cover member 122 away from spring stop wall 95. Depressing planar top wall 132 towards housing 12 causes spring 138 to deflect such that release of deflectable cover member 132 allows spring 138 to urge cover member 132 away from housing 12.

Deflectable cover member 122 further includes a first and second fixed elongate blocking arms 140 and 142. Blocking arms 140 and 142 include a planar blocking lug 144 and 146 at a distal end thereof and define an elongate recess 140*a* and 142*a* extending between blocking lug 144 and 146 and perimetrical wall 134, respectively. Blocking lugs 144 and 146 are therefore substantially linearly movable with deflectable cover member 122 between an undeflected position and deflected position against the urging of spring 138.

As shown in FIG. 2A, blocking lugs 144 and 146 are positioned adjacent interior latch lugs 150 and 152 in an undeflected position to thereby prevent deflection of latch arms 50 and 52 towards shaft 54. Thus, in the undeflected position, connector 10 may not be inserted into, or withdrawn from, socket cavity 30 as the exterior latch ribs 62 and 64 are spaced too far outward from shaft 54. While FIG. 2A shows that electrical connection may be established between leads 32 and 34 and socket contacts 17 and 19, respectively, prior to latch ribs 62 and 64 extending into socket cavity 30, the present invention contemplates that, by positioning either socket contacts 17 and 19 deeper within shaft 54 or leads 32 and 34 deeper within socket cavity 30, electrical connection may be delayed until mechanical retention is more likely established. FIG. 2B shows that as deflectable cover member 122 is deflected towards housing 12, spring 138 deflects and blocking lugs 144 and 146 extend further towards connector face 56 at the free end of shaft 54 so as to position recesses 140*a* and 142*a* adjacent latch lugs 150 and 152. Consequently, when deflectable cover member 122 and blocking lugs 144 and 146 are in the deflected position, latch arms 50 and 52 may be deflected towards shaft 54 to thereby allow connector 10 to be inserted into, or withdrawn from, socket cavity 28.

As seen FIGS. 2C–E, with latch arms 50 and 52 deflected towards shaft 54, connector 10 may be inserted into socket cavity 28 so as to align latch ribs 62 and 64 with mating groove 66. It is contemplated that by tapering the leading edges of latch ribs 62 and 64, an operator need not manually deflect latch arms 50 and 52 as such will occur with continued insertion forces while cover member 122 is deflected. That is, as connector 10 is inserted into female connector 26, engagement between projecting ribs 62, 64 against connector wall 28 causes arms 50, 52 to deflect towards male connecting portion 54. By either insertion method, once projecting ribs 62, 64 reach mating groove 66, deflectable arms 50, 52 spring outwards from male connecting portion 54 to provide mechanically-locked engagement between connector 10 and female connector 26. In order to withdraw connector 10 from female connector 26, cover member 122 must be deflected towards housing 12 and deflectable arms 50, 52 must be simultaneously deflected towards male connecting portion 54 until ribs 62, 64 are clear of mating groove 66 and then pulled from cavity 30.

Referring to FIGS. 4–14B, an alternate connector 210 of the present invention is shown. Connector 210 requires two independent operator actions for establishing mechanical and electrical connection within a connector assembly and three independent operator actions to mechanically and electrically disconnect from the connector assembly. Connector 210 includes a housing 212 and a cover 214 for mating engagement with the housing 212 so as to contain a first and a second contact element 216 and 218, respectively, and a ferrite component 220. First and second contact elements 216 and 218 each terminate at opposed first and second socket contacts 217, 219 first and second wire 222, 224, respectively. Wires 222 and 224 each extend through ferrite component 220 and provide a pigtail connection end 222*a* and 224*a* exterior to connector 210. Connector 210 employs an adjustable locking key 215 for controlling both mechanical locking of connector 210 and electrical shorting of the firing circuit established by connector 210 and an airbag gas generator squib (not shown). Housing 212 and cover 214 are formed from a suitable dielectric material. Connector 210 provides mating engagement with a female connector 226, shown in FIGS. 13A–14B, of an airbag gas generator assembly, not shown.

Socket connector 226 includes a connector wall 228 defining a female connector cavity 230 in which a pair of electrical lead pins 232 and 234 are positioned. Connector wall 228 defines a mating groove 266 opening towards connector cavity 230 so as to provide mechanical retention of a connector therein. Female connector 226 may further include a conductive shorting clip 236 extendable across pins 232 and 234 within cavity 230 for providing protection against unintentional initiation of the airbag gas generator assembly by a current induced from electrostatic discharge arcing to one of lead pins 232 or 234. In some configurations, shorting clip 236 is provided by an intermediate insert 238 positioned within cavity 230. As shown in FIG. 13C, shorting clip 236 typically includes a clip body 240 and a pair of clip appendages 242 and 244 each bent so as to deflectably contact one of pins 232 and 234 and thereby provide a short circuit thereacross. Upon insertion of connector 210, clip appendages 242 and 244 are deflected away from pins 232 and 234 by the dielectric material of housing 212 so as to allow a firing circuit to be established with the airbag gas generator.

Housing 212 includes a pair of cantileverally-deflectable latch arms 250, 252 extending from the distal end 254*a* of a shaft 254. Shaft 254 terminates at a planar connector face 256 and is insertable into female connector cavity 230 to establish both mechanical and electrical connection. Connector face 256 defines a pair of socket apertures 258, 260 positioned in underlying registry with socket contacts 217, 219 so as to enable lead pins 232, 234 to be inserted therein and establish electrical connection between the airbag gas generator and the firing circuitry.

Deflectable latch arms 250, 252 each include a projecting rib 262, 264 thereon for insertion into a mating groove 266 in socket wall 228. As connector 210 is inserted into socket connector 226 with locking key 215 in a raised position, engagement between projecting ribs 262, 264 against connector wall 228 causes latch arms 250, 252 to deflect towards shaft 254. Once projecting ribs 262, 264 reach mating groove 266, deflectable latch arms 250, 252 spring outwards from shaft 254 to provide mechanically-locked engagement between connector 210 and female connector 226. In order to withdraw connector 210 from female connector 226, deflectable latch arms 250, 252 must be simultaneously deflected towards shaft 254 until ribs 262, 264 are clear of mating groove 266 and then pulled from cavity 230.

Shaft 254 defines a pair of adjacent elongate channels 294, 296 opening in facing opposition to the appendages 242, 244 of shorting clip 236 when connector 210 is inserted into female connector 226. Connector portion 254 further defines a pair of socket cavities 298, 299 for retentatively receiving socket contacts 217, 219 therein.

Figure 11:
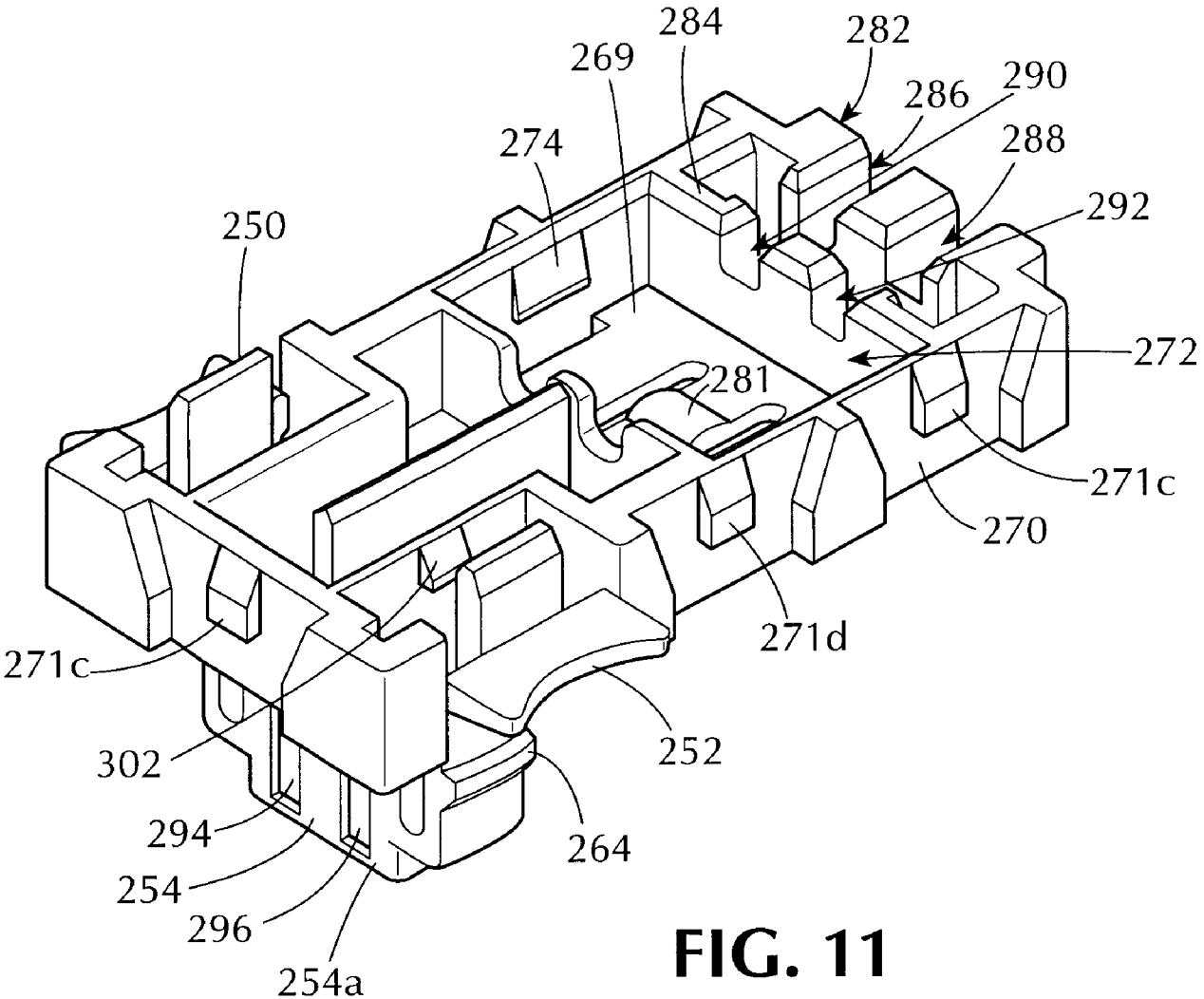
FIG. 11 is an oblique view of the housing of the plug connector of FIG. 5.

Referring now to FIG. 11, housing 212 further includes a bottom wall 269 and a perimetrical housing wall 270 which defines an interior cavity 272. Interior cavity 272 retentatively receives first and second contact elements 216, 218 and ferrite component 220 therein. Housing wall 270 includes a pair of opposed retention clips 274, 276 facing across interior cavity 272 for engaging a pair of oppositely-extending locking ledges 278, 280 formed on ferrite component 220. Bottom wall 269 includes a deflectable protrusion 281 facing interior cavity 272 for retentatively forcing locking ledges 278, 280 of ferrite component 220 against retention clips 274, 276 on housing wall 270.

Housing 212 further includes a crenelated back wall 282 and a crenelated interior wall 284 spaced parallel thereto. Both crenelated walls 282 and 284 define a pair of adjacent apertures 286, 288, and 290, 292 for receiving wires 222 and 224 therein. Back wall 282 further includes a locking barbs (not shown) extending into apertures 290 and 292 for retaining wires 222 and 224 in place.

Figure 10:
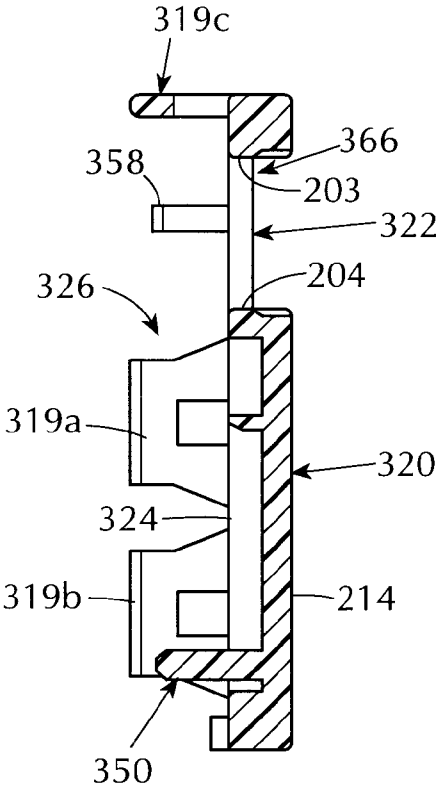
FIG. 10 is a cross-sectional view of the cover of FIG. 9 taken through the line 10—10.
Figure 9:
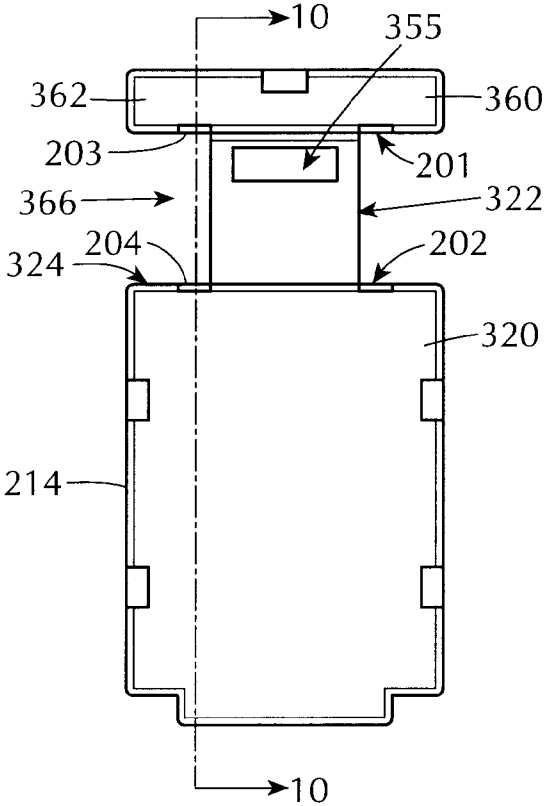
FIG. 9 shows a top-elevational view of the cover of the plug connector of FIG. 5.
Figure 12B:
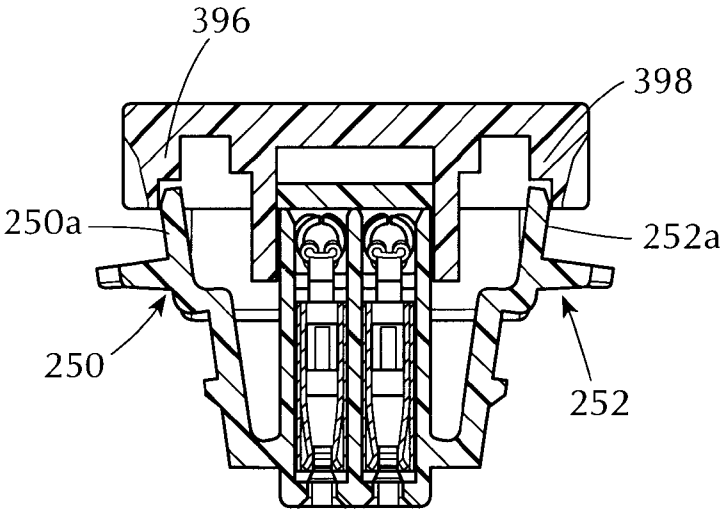
FIGS. 12A–B show alternate sectional views of the plug connector of FIG. 5 prior to insertion into a socket connector.
Figure 12A:
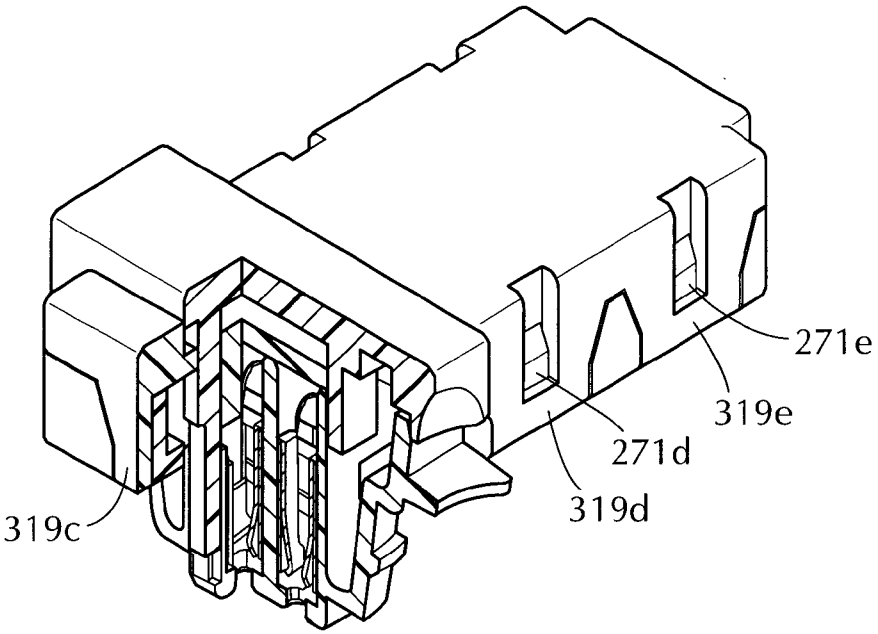

With additional reference to FIGS. 9–10 and 12A, cover 214 of connector 210 is affixed to housing 212 by means of detent arms 319*a–e* deflectably engaging and retaining housing protrusions 271*a–e* formed on housing 212. Cover 214 includes a planar top wall 320, a forward key-accommodating member 322, and a depending perimetrical wall 324. Perimetrical wall 324 defines a cover cavity 326 to be positioned in overlying registry with interior cavity 272 of housing 212 when connector 210 is assembled. Cover 214 also includes an interior crenelated wall 350 projecting from top wall 320 into cover cavity 326. Crenelated wall 350 defines a pair of wire passages for receiving wires 224, 226 therein once connector 210 is assembled. Crenelated wall 350 is formed to extend between crenelated walls 282 and 284 of housing 212.

Key-accommodating member 322 includes a pair of transversely-spaced forward legs 356, 358 depending therefrom and defines a key insertion aperture 355 adjacent to, and forward of, forward legs 356, 358. Key-accommodating member 322 also provides a pair of oppositely-extending cover shoulders 360, 362 longitudinally spaced from cover perimetrical wall 324 by cross-piece 364 from which forward legs 356, 358 depend. Cover 214 defines a key-accommodating space 366 between cover shoulders 360, 362 and cover perimetrical wall 324.

Figure 7:
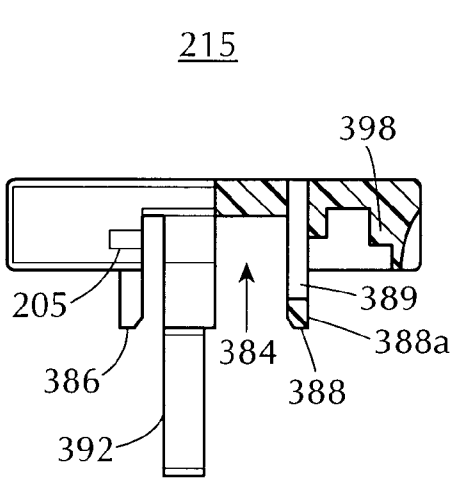
FIGS. 6–8 depicts the locking button of the plug connector of FIG. 5.
Figure 8:
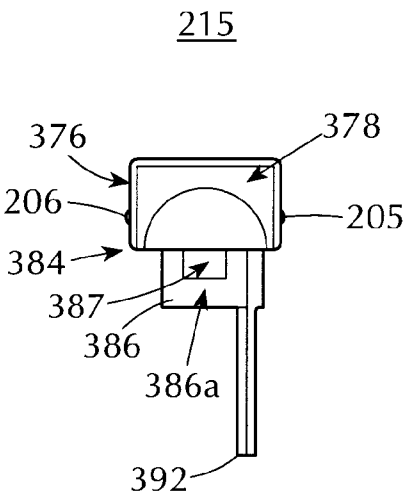
Figure 6:
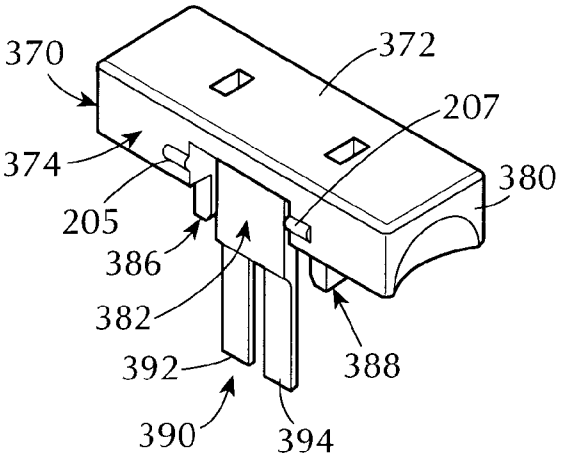

With particular reference to the FIGS. 6–8, locking key 215 of connector 210 includes an upper button 370 which is manually engaged for manipulating and positioning key 215 within connector 210. Button 370 includes an elongate transversely-oriented planar upper wall 372, depending crenelated forward and rear button walls 374 and 376, respectively, and transversely-spaced depending endwalls 378, 380. Walls 374, 376, 378, and 380 define an interior button cavity 382. Crenelated button walls 374 and 376 each define longitudinally-registered notches 382 and 384, respectively, for receiving cross-piece 364 of cover 214.

Locking key 215 and cover 214 include cooperatively engaging detents for positively holding locking key in the raised or lowered position. Detents 201–204 on cover 214 provide overridable staggered engagement with cooperating detents 205–208 on crenelated button walls 274 and 276. Locking key 215 and housing 212 also include cooperatively engaging retention features which prevent locking key 215 from being separated from the remainder of connector 210. Locking arms 286 and 288 each define an elongate retention slot 287, 289 having one end closed by a the distal arm end 286*a* and 288*a,* respectively. Housing 212 provides a retention pin 701, 702, on perimetrical wall 270 in facing opposition to a latch arm 250, 252 for slidable retention within retention slot 287, 289, respectively, as locking key 215 is raised and lowered.

Locking key 215 further includes a pair of transversely-spaced, longitudinally-extending mechanical locking arms 386, 388 and an electrical safing element 390 depending from upper wall 372 through button cavity 382. Electrical safing element 390 further includes a pair of transversely-spaced fixed arms 392, 394 which function to provide engagement and disengagement between clip appendages 242, 244 of shorting clip 236 and lead pins 232, 234. Electrical safing element 390 passes through key-insertion aperture 355 when assembled. With additional reference to FIGS. 3–10*b,* locking key 215 provides a pair of latch arm stops 396, 398 within button cavity 382 adjacent to endwalls 378, 380.

Locking key 215 is adjustable within connector 210 so as to both control the shorting engagement of shorting clip 226 across lead pins 232, 234 and to prevent the inadvertent mechanical disconnection of connector 210 from female connector 226. As will be described hereinbelow, locking key 215 is adjustable between a raised and unlocked position and a lowered and locked position. In the raised and unlocked position, fixed arms 392, 394 are retracted along channels 294, 296 so as not to interfere with lead pins 232, 234 being shorted by shorting clip appendages 242, 244. Simultaneously, when locking key is in the raised and unlocked position, latch arms 250, 252 may be deflected towards shaft 254. Conversely, when locking key 215 is in the lowered and locked position, shorting clip appendages 242, 244 are disengaged from lead pins 232, 234 by fixed arms 392, 394 and locking arms 386, 388 prevent the deflection of latch arms 250, 252. The raised and unlocked position of locking key 215 is shown in FIGS. 12–13B while the lowered and locked position of locking key 215 is shown in FIGS. 14A–B.

FIGS. 12A–B show another attribute of connector 210. When connector 210 is free from female connector 226, locking key 215 is in a raised position and latch arms 250, 252 outwardly deflect to an at-rest position whereby their free ends 250*a,* 252*a* are positioned adjacent latch arm stops 396, 398 so as to prevent locking key 215 being lowered. This feature of the present invention ensures that shorting clip 236 maintains the short circuit across lead pins 232, 234 while the mechanical engagement between connector 210 and female connector 226 is being established. Insertion of shaft 254 into female connector 226 causes latch arms 250, 252, either with or without concurrent manual assistance, to deflect inwards towards shaft 254 so as to position ribs 262, 264 within mating groove 266.

Figure 13B:
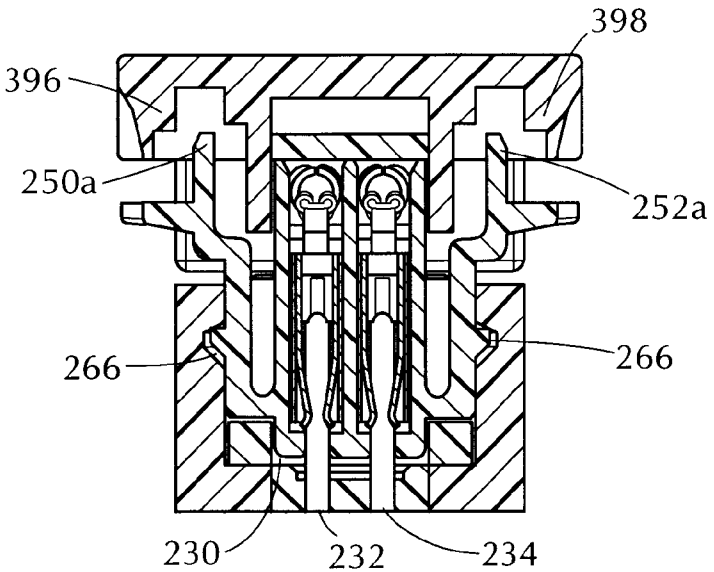
FIGS. 13A–B show alternate sectional views of the plug connector of FIG. 5 upon insertion into a socket connector prior to fully depressing the locking button to mechanically lock the connector in place and electrically enable an airbag firing circuit.
Figure 13A:
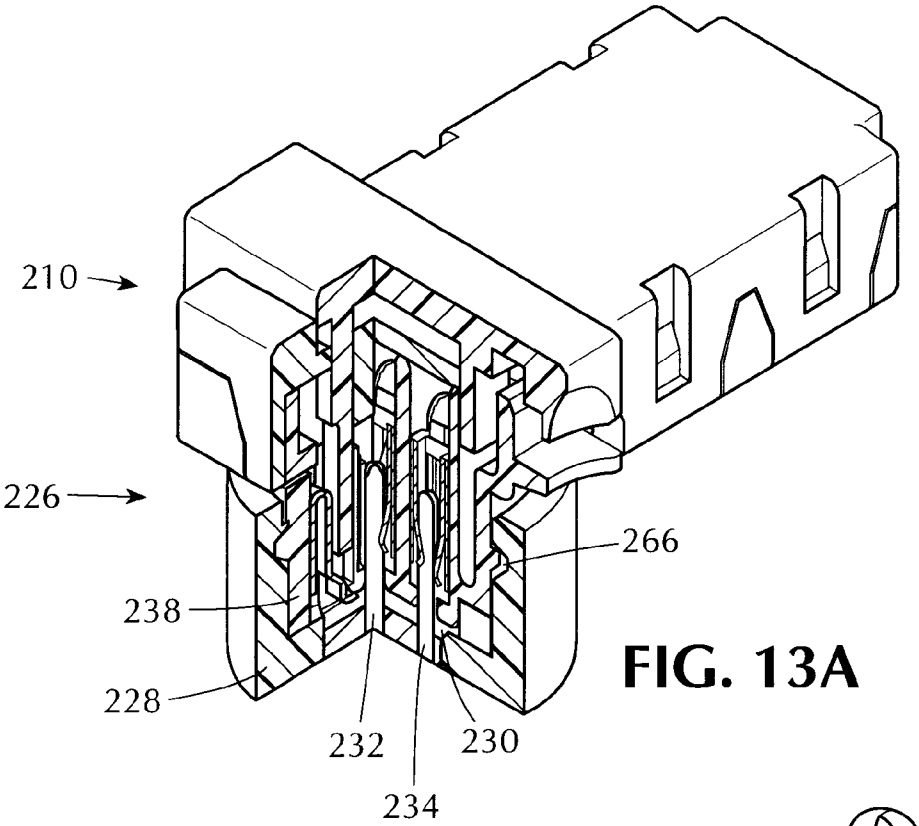
Figure 13C:
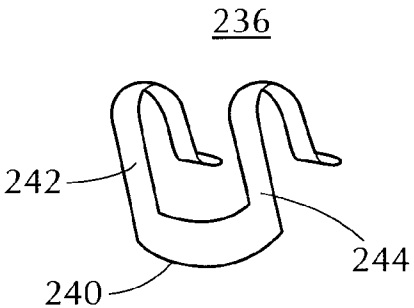
FIG. 13C depicts a shorting clip employed in the socket connectors engaged by the plug connectors of the present invention.

As made clear by FIGS. 13A–B, the positioning of ribs 262, 264 within mating groove 266 results in sufficient inward deflection of latch arms 250, 252 to position their free ends 250*a,* 252*a* clear of latch stops 396, 398 and allow for subsequent lowering of locking key 215. The present invention thereby ensures that the shorting of lead pins 232, 234 is maintained until the electrical engagement between lead pins 232, 234 and socket contacts 217, 219 is established.

Figure 14B:
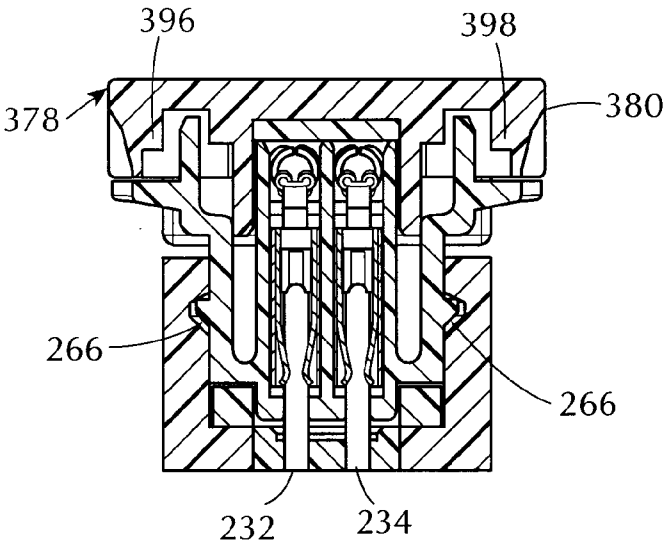
FIGS. 14A–B show alternate sectional views of the plug connector of FIG. 5 after depressing the locking button to mechanically lock the connector in place and electrically enable an airbag firing circuit.
Figure 14A:
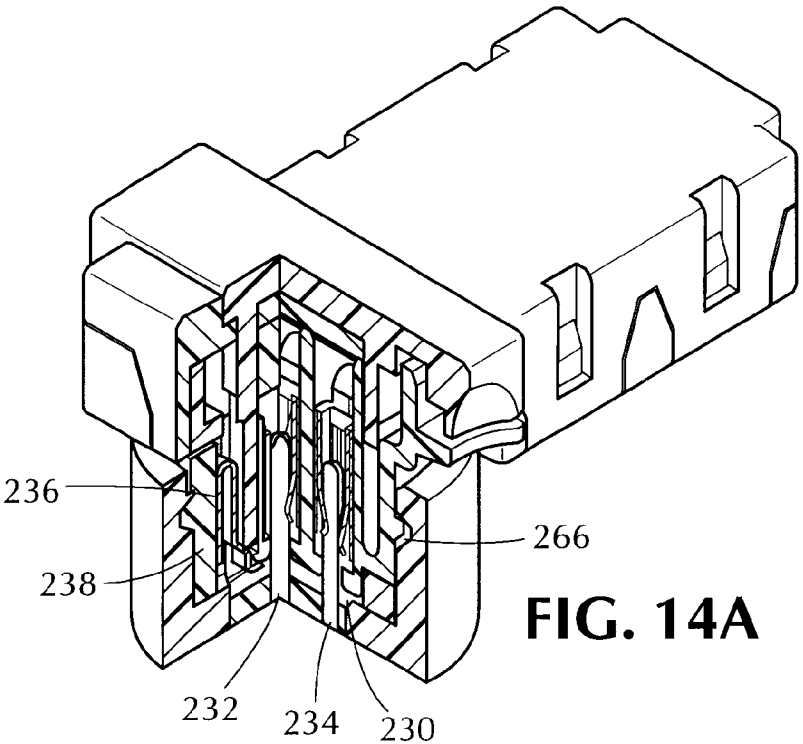
Figure 15:
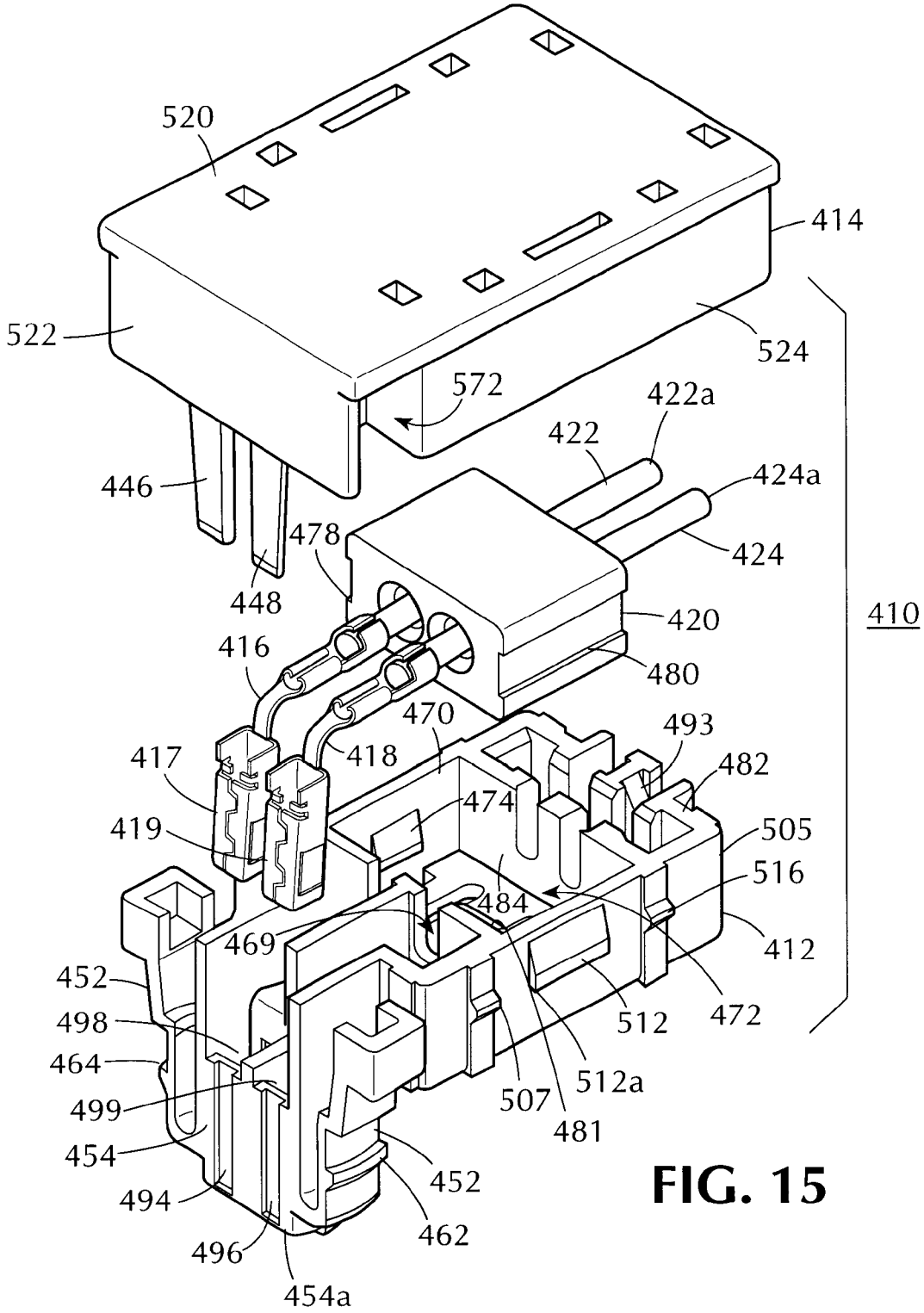
FIG. 15 is an exploded view of yet another plug connector of the present invention.

Referring now to FIGS. 14A–B, locking key 215 may now be pressed to the lowered position and thereby both mechanically lock the connector in place and electrically enable the airbag firing circuit. In the lowered position, locking key 215 extends fixed arms 392, 394 along channels 294, 296 of shaft 254 to disengage shorting clip appendages 242, 244 from lead pins 232, 234. Furthermore, in the lowered position, locking key 215 positions locking arms 386, 388 adjacent latch arms 250, 252 and thereby prevents their inward deflection as would be required for disconnecting connector 210 from female connector 226. As is shown in the Figures, latch arms 250, 252 are preferably contoured to conforms to endwalls 378, 380 and further thwart inadvertent disengagement of locking key 215. Similarly, when connector 210 is mechanically locked in female connector 226, locking key 215 may be raised and lowered as desired so as to provide a shorted or unshorted path across lead pins 232, 234, as desired.

Referring now to FIGS. 15–20, yet another connector 410 of the present invention requires two independent operator actions to both establish and break from secure mechanical and electrical connection with a connector assembly. Connector 410 includes a housing 412 and a cover 414 for mating engagement with the housing 412 so as to contain a first and a second contact element 416 and 418, respectively, and a ferrite component 420. First and second contact elements 416 and 418 each terminate at opposed first and second socket contacts 417, 419 first and second wire 422, 424, respectively. Wires 422 and 424 each extend through ferrite component 420 and provide a pigtail connection end 422*a* and 424*a* exterior to connector 410.

Housing 412 and cover 414 are formed from a suitable dielectric material. Connector 410 provides mating engagement with a female connector 426, shown in FIGS. 16A and 17, of an airbag gas generator assembly, not shown.

Female connector 426 includes a connector wall 428 defining a female connector cavity 430 in which a pair of electrical lead pins 432 and 434 are positioned. Connector wall 428 defines a mating groove 466 opening towards connector cavity 430 so as to provide mechanical retention of a connector therein. Female connector 426 may further include a shorting clip 436 deflectably connected across pins 432 and 434 within cavity 430 for providing protection against unintentional initiation of the airbag gas generator assembly by a current induced from electrostatic discharge arcing to one of lead pins 432 or 434. In some configurations, shorting clip 436 is provided by an intermediate insert 438 positioned within cavity 430. Shorting clip 436 typically includes a clip body 440 and a pair of clip appendages 442, shown in FIG. 13C, and 444 each bent so as to deflectably contact one of pins 432 and 434 and thereby provide a short circuit thereacross. Upon insertion of connector 410, clip appendages 442 and 444 are deflected away from pins 432 and 434 by the dielectric material of housing 412 so as to allow a firing circuit to be established with the airbag gas generator.

Housing 412 includes a pair of cantileverally-deflectable arms 450, 452 extending from the distal end 454*a* of a shaft 454. Shaft 454 terminates at a planar connector face 456 and is insertable into female connector cavity 430 to establish both mechanical and electrical connection. Connector face 456 defines a pair of socket apertures 458, 460 positioned in underlying registry with socket contacts 417, 419 so as to enable lead pins 432, 434 to be inserted therein and establish electrical connection between the airbag gas generator and the firing circuitry.

Deflectable arms 450, 452 each include a projecting rib 462, 464 thereon for insertion into a mating groove 466. As connector 410 is inserted into female connector 426, engagement between projecting ribs 462, 464 against connector wall 428 causes arms 450, 452 to deflect towards shaft 454. Once projecting ribs 462, 464 reach mating groove 466, deflectable arms 450, 452 spring outwards from shaft 454 to provide mechanically-locked engagement between connector 410 and female connector 426. In order to withdraw connector 410 from female connector 426, deflectable arms 450, 452 must be simultaneously deflected towards shaft 454 until ribs 462, 464 are clear of mating groove 466 and then pulled from cavity 430.

Shaft 454 defines a pair of adjacent elongate channels 494, 496 opening in facing opposition to the appendages 442, 444 of shorting clip 436 when connector 410 is inserted into female connector 426. Shaft 454 further defines a pair of socket cavities 498, 499 for retentatively receiving socket contacts 417, 419 therein.

Housing 412 further includes a bottom wall 469 and a perimetrical housing wall 470 which defines an interior cavity 472. Interior cavity 472 retentatively receives first and second contact elements 416, 418 and ferrite component 420 therein. Housing wall 470 includes a pair of opposed retention clips 474, 476 facing across interior cavity 472 for engaging a pair of oppositely-extending locking ledges 478, 480 formed on ferrite component 420. Bottom wall 469 includes a deflectable protrusion 481 facing interior cavity 472 for retentatively forcing locking ledges 478, 480 of ferrite component 420 against retention clips 474, 476 on housing wall 470.

Housing 412 further includes a crenelated back wall 482 and a crenelated interior wall 484 spaced parallel thereto. Both crenelated walls 482 and 484 define a pair of adjacent apertures 486, 488, and 490, 492 for receiving wires 422 and 424 therethrough. Back wall 482 further includes a locking elements 491, 493 extending into apertures 486, 490 for retaining wires 422 and 424 in place.

Housing wall 470 includes eight exteriorly-facing detents 500–508 thereon. Housing wall 470 also includes a pair of oppositely-extending stop elements 510, 512 having downward-facing planar stop faces 510*a*, 512*a*, respectively. While detents 500-308 are preferably positioned about a plane extending slightly above a plane including stop faces 510*a* and 512*a*, detents 502, 503 and 506, 507 also preferably extend slightly farther out from housing wall 470 than their adjacent stop elements 510 and 512.

Cover 414 includes a planar top wall 520, a depending front wall 522, and a depending perimetrical wall 524. A pair of fixed arms 446, 448, which function to provide engagement and disengagement between clip appendages 442, 444 of shorting clip 436 and lead pins 432, 434, depend from front wall 522. Perimetrical wall 524 defines a cover cavity 526 for receiving perimetrical wall 470 of housing 412 when connector 410 is assembled. Cover 414 also includes an interior crenelated wall 550 projecting from top wall 520 into cover cavity 526. Crenelated wall 550 defines a pair of wire passages 552, 554 for receiving wires 424, 426 therein once connector 410 is assembled. Crenelated wall 550 is formed to extend between crenelated walls 482 and 484 of housing 412.

Figure 16B:
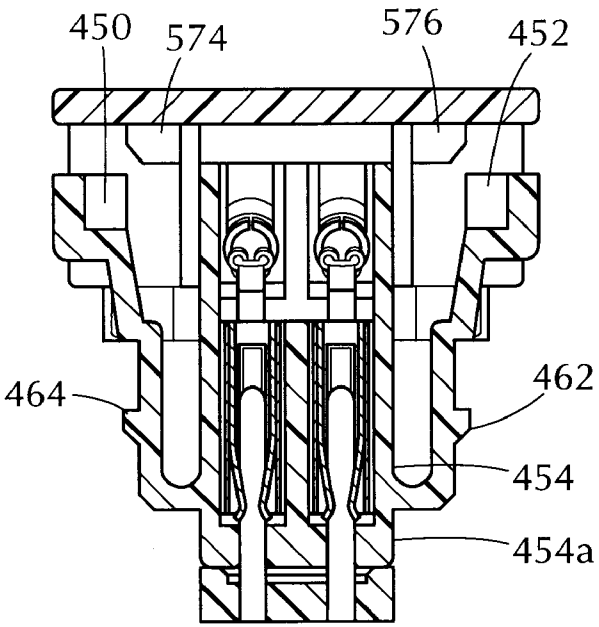
FIGS. 16A–B are cross-sectional views of the plug connector of FIG. 15 inserted into a socket having a pair of protruding lead pins, with the cover in the down and latch-locked position for disengaging a shorting clip extending across the lead pins, and with the cover in the raised position permitting the shorting clip to extend across the lead pins and the connector latches to deflect.
Figure 16A:
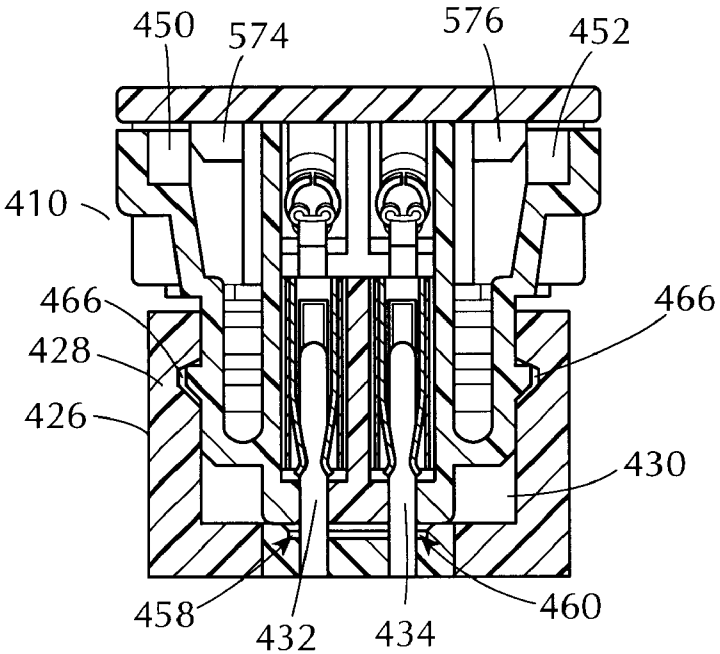
Figure 17:
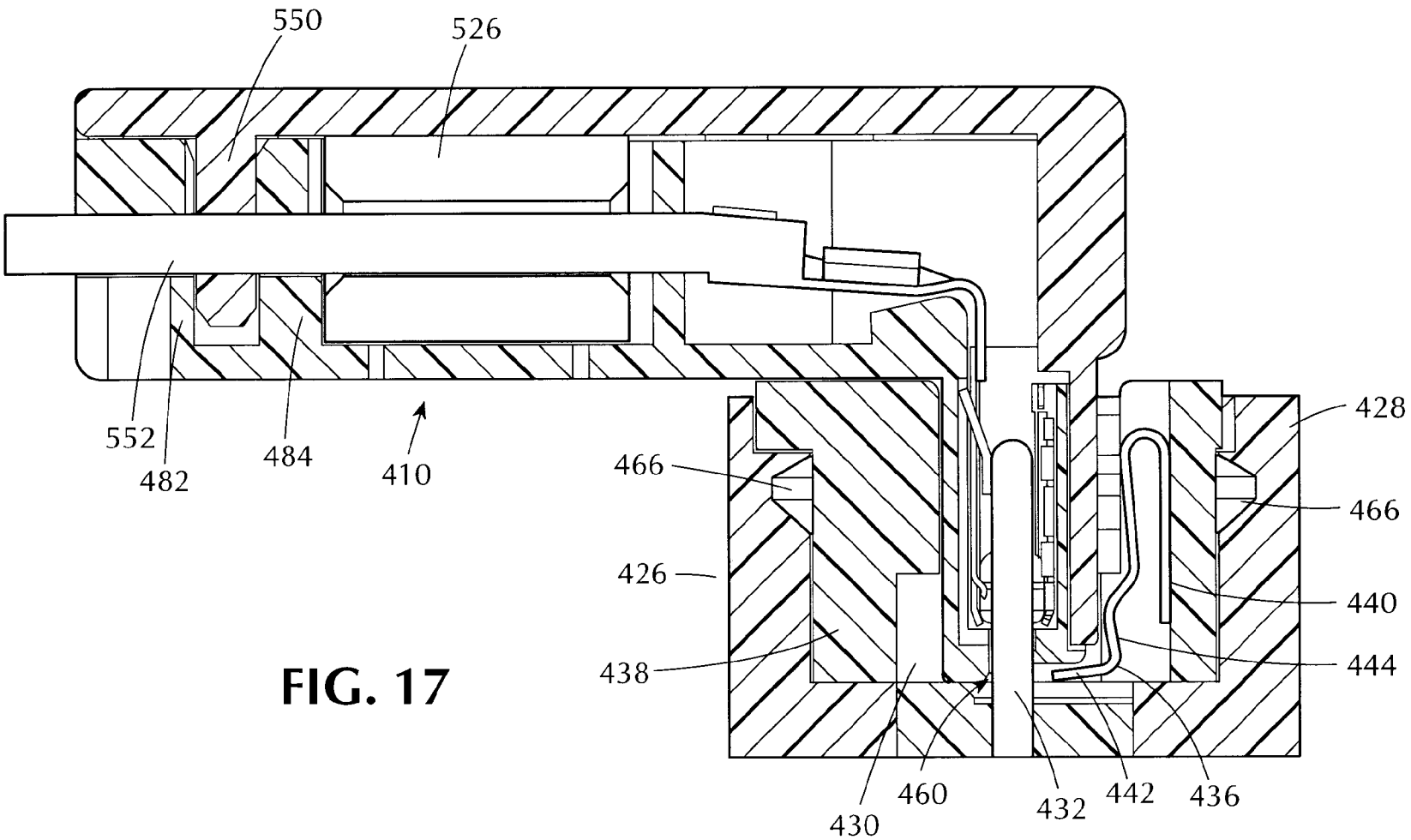
FIG. 17 is a longitudinal cross-sectional view of the plug connector of FIG. 15 inserted in a socket connector, showing the shorting clip in the disengaged position.
Figure 19:
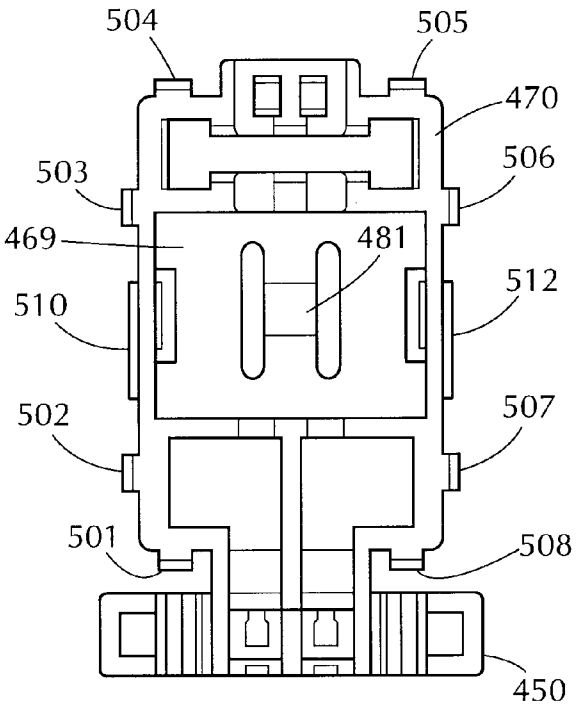
FIG. 19 is a top elevational view of the plug connector housing of the connector of FIG. 15.
Figure 20:
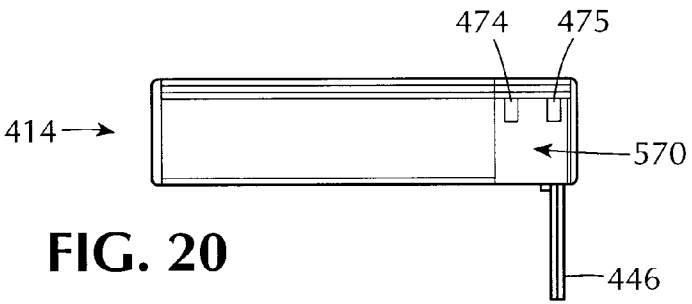
FIG. 20 is a side elevational view of the plug connector cover of the plug connector of FIG. 15.
Figure 18:
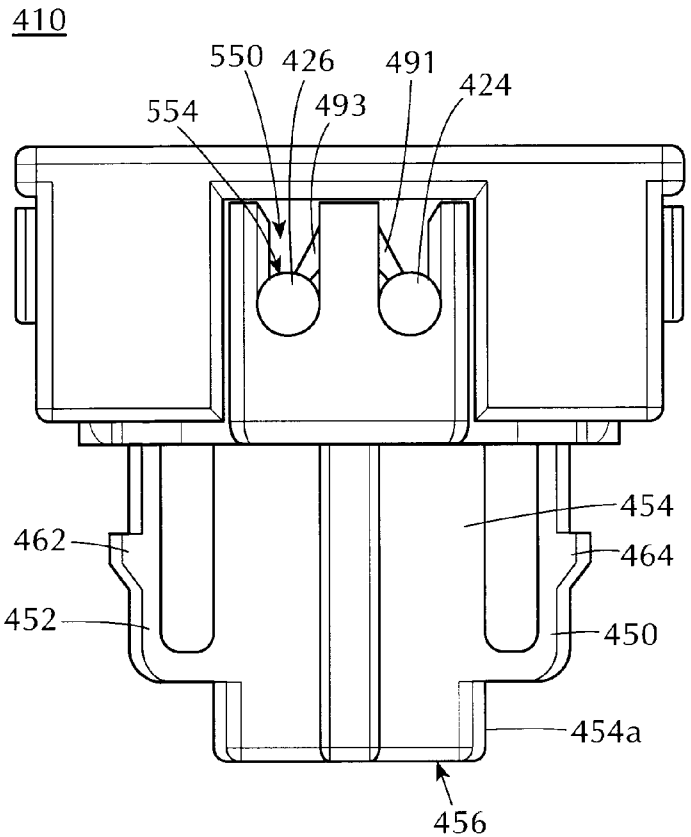
FIG. 18 is a side elevational view of the connector of FIG. 15, showing the pigtail wires projection from the connector.

Cover 414 includes opposed recesses 570 and 572 for receiving deflectable arms 450 and 452, respectively. Planar top wall 520 and perimetrical wall 524 support blocking lugs 574 and 575 in recess 570 and blocking lugs 576 and 577 in recess 572. Blocking lugs 574, 575 and 576, 577 are positionable adjacent the free ends of deflectable latches 450 and 452, as shown in FIG. 16A when cover 414 is in the down position, so as to prevent their deflection towards shaft 454 and thereby preventing shaft 454 from being either inserted into or withdrawn from socket cavity 430. When cover 414 is in the raised position, blocking lugs 574, 575 and 576, 577 will be raised clear of deflectable latches 450 and 452, as shown in FIG. 16B, so as to allow their deflection towards shaft 454 and thereby allow for shaft 454 to be inserted into or withdrawn from socket cavity 430.

Perimetrical wall 524 of cover 414 includes eight interiorly-facing detents 530–538 formed to cooperatively abut detents 501–508 of housing 412 in the lowered and locked configuration. Detents 531–538 pass over and back across detents 501–508 as cover 414 is moved between the lowered and locked and the raised and unlocked configurations. Relative travel between cover 414 and housing 412 is limited by the abutting engagement between stop elements 510, 512 on housing 412 and a pair of oppositely facing cover stops 540, 542 formed between detents 532, 533, and 536, 537, respectively. Cover stops 540, 542 each include planar stop surfaces 540*a*, 542*a*, respectively for abutting engagement with stop surfaces 510*a*, 512*a*, respectively.

Cover 414 is shown in the down and locked position with respect to housing 412, as depicted in FIG. 16A. The down and locked position sufficiently extends fixed arms 446, 448 within channels 494, 496 of housing 412 so as to be in position to disengage clip appendages 446, 448 from shorting engagement across lead pins 432, 434 of female connector 426. The down and locked position also places blocking lugs 574, 575 and 576, 577 adjacent the free end of deflectable latches 450 and 452 to prevent their deflection towards shaft 454. Cover 414 may also be withdrawn to a raised and unlocked position, shown in FIGS. 16B, which removes fixed arms 446, 448 from blocking engagement of clip appendages 446, 448 so that shorting contact across lead pins 432, 434 may be re-established while maintaining connector 410 mechanically engaged with female connector 426. Thus, only when fixed arms 446 and 448 are clear from shorting clip appendages 446 and 448 will blocking lugs 574, 575 and 576, 577 be clear of deflectable latches 450 and 452 to thereby allow withdrawal or insertion of connector 410 through socket cavity 430. Alteratively, when connector 410 is mechanically locked in female connector 426, cover 414 may be raised and lowered as desired so as to provide a shorted or unshorted path across lead pins 432, 434.

Referring now to FIGS. 21–23C, it is desirable to provide keying accommodation between the shaft and plug of the present invention. Keying the shaft and plug assists in preventing relative rotation between the shaft of the plug connector and the socket connector which can cause the socket contacts and leads to be unaligned. Improper alignment between the socket and leads can result in the leads being bent by insertion of the shaft into the socket. The present invention assures the mechanical alignment between the shaft and socket connector so as to align the leads with the socket contacts by providing a cooperative keying structure to both the shaft and the socket connector. It is desirable that the tolerances of the fit between the shaft and the socket are sufficiently tight to ensure that the alignment therebetween is established prior to the socket leads entering the socket contacts of the plug connector.

Figure 23A:
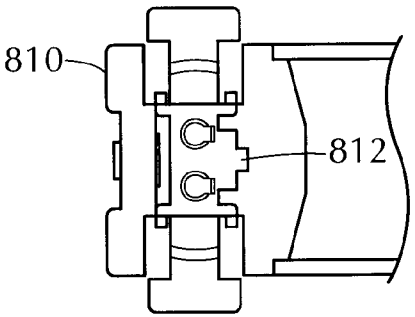
FIGS. 23A–C depict coding variants for the keying design of the present invention.
Figure 23C:
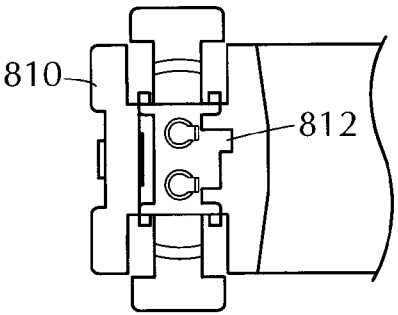
Figure 23B:
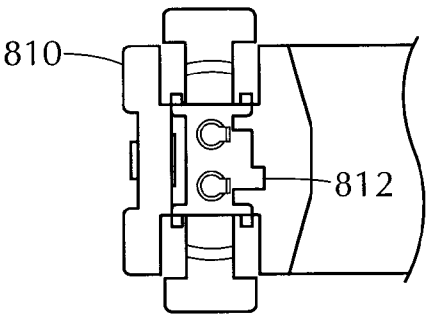
Figure 21:
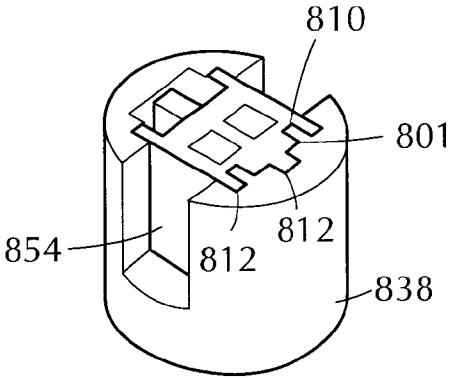
FIG. 21 is an oblique sectional view of a keying design for a plug connector and socket connector of the present invention.
Figure 22:
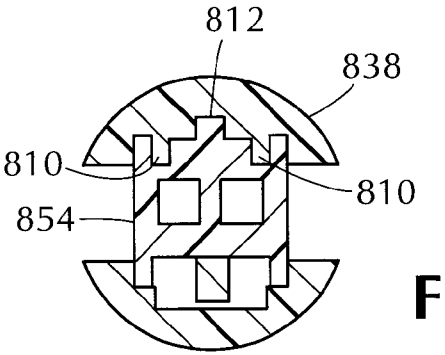
FIG. 22 is a top sectional view of the keying design of FIG. 21.
Figure 25:
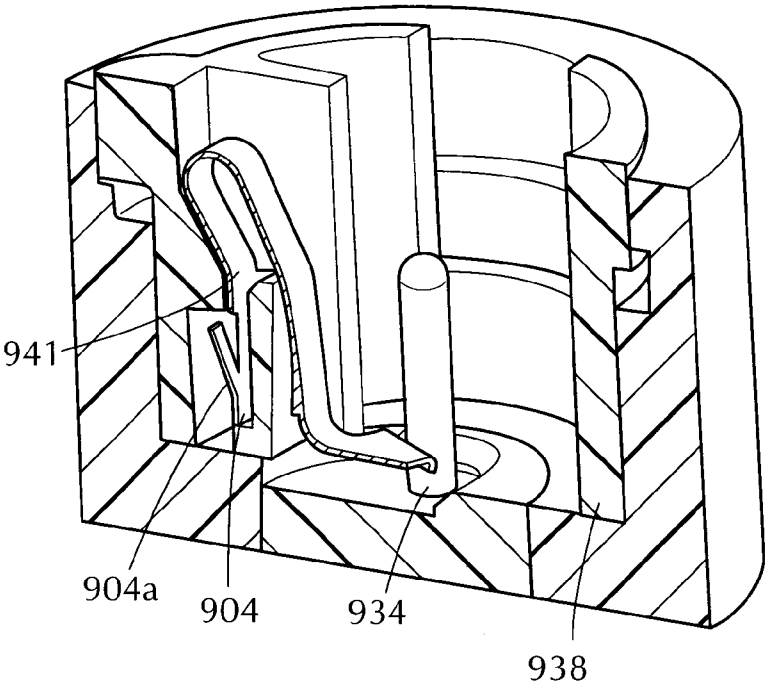
FIG. 25 is a second cross-sectional view of the socket connector of FIG. 24.
Figure 24:
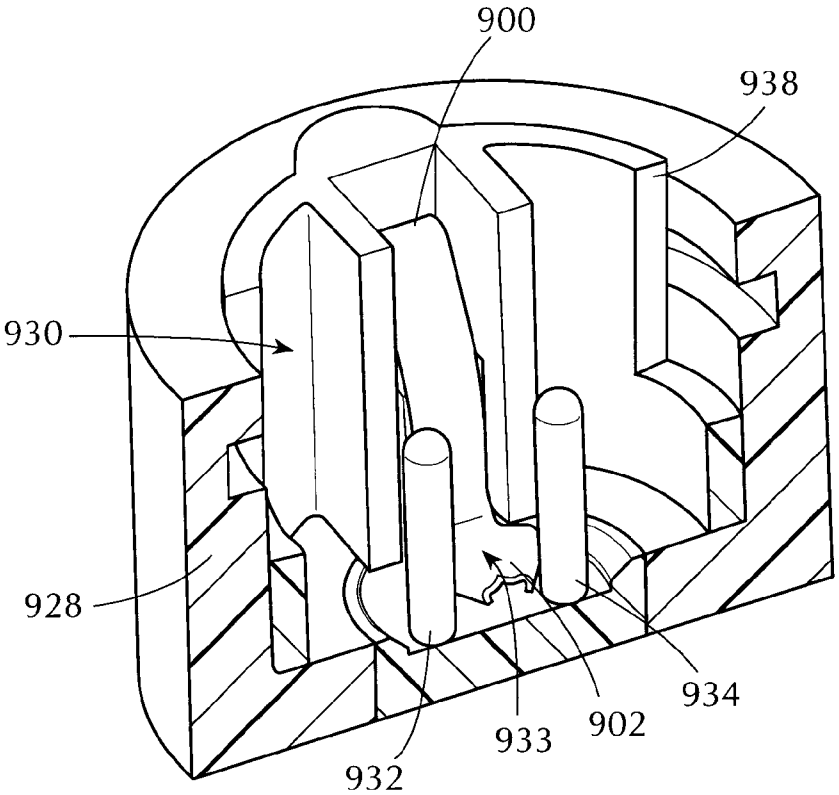
FIG. 24 is a first cross-sectional view of a socket connector of the present invention.
Figure 27:
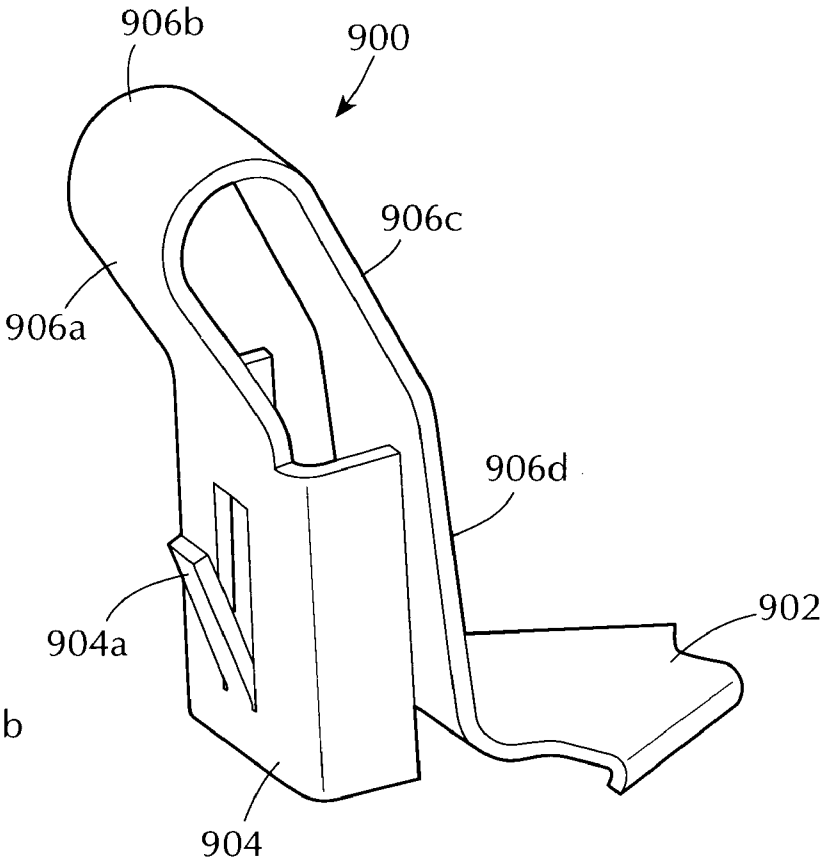
FIGS. 26–27 depict alternate oblique sectional views of the socket connect of FIG. 24.
Figure 26:
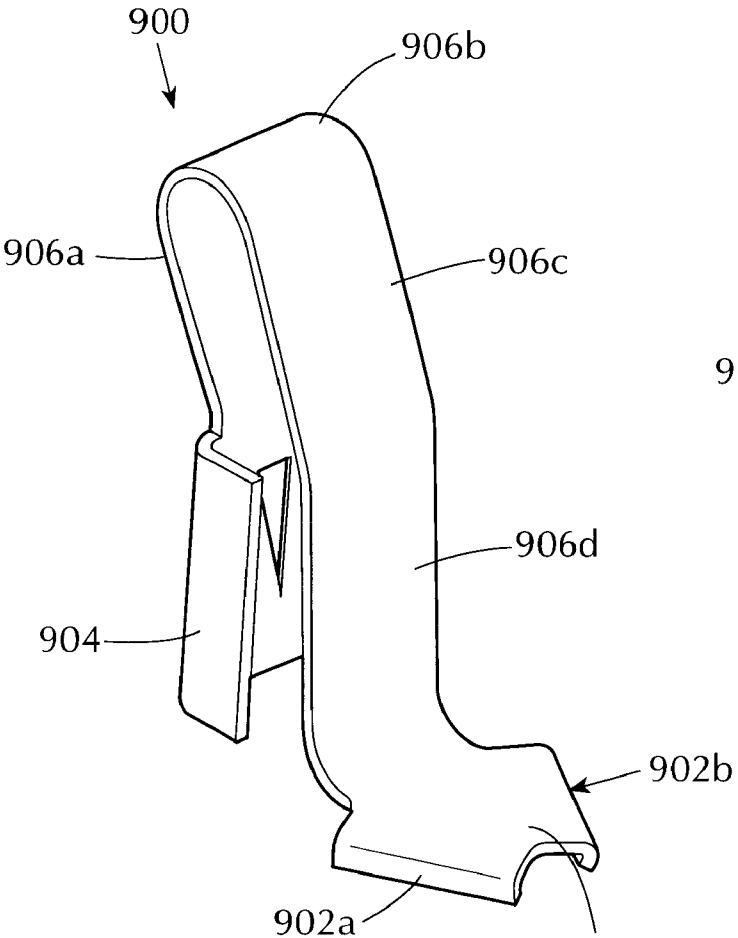

As seen in FIGS. 21–23, the keying structure employs a crenelated interface 801 between the shaft 854 of the plug connector 810 and either the socket connector 826 or a socket insert 838 supporting a shorting clip. Cooperative grooves 810 and protuberances 812 are formed on plug connector shaft 854 and on socket housing 825 to ensure plug connector 810 is correctly oriented with respect to socket 826 prior to insertion thereinto. As additionally seen in FIGS. 23A–C, the crenellations of the keying structure 801 may be altered by shifting one socket channel 814 and one shaft protuberance 816 so as to differentiate connectors and sockets for different locations or airbags within a single vehicle. The different keying structures are especially useful for multiple airbag applications where more than one airbag is provided and which are varyingly deployed in response to different impact environments.

Referring now to FIGS. 24–27, a shorting clip for use in a socket connector is also disclosed. Shorting clip 900 is an elongate member having a single wedge-shaped head 902 for engaging a pair of leads 932 and 934 within the socket cavity 930 defined by a socket housing 928. Leads 934 and 934 define a gap 933 therebetween into which head 902 of shorting clip 900 extends in order to make shorting engagement thereacross. Head 902 includes a pair of tapered edges 902*a* and 902*b* which make contact with lead 932 and 934, respectively, to establish the short circuit across the leads.

Shorting clip 900 also includes a tail 904 embedded in either socket housing 926 itself or in a socket insert 938 which is retained in socket cavity 930. Tail 904 includes a retention barb 904*a* which permits insertion of tail 904 into a preformed shorting clip aperture 941 and which retentatively engages socket insert 938 to prevent withdrawal therefrom.

Shorting clip 900 further includes an elongate clip body 906 extending between head 902 and tail 904. Starting from tail 904, body 906 includes a first portion 906*a* obliquely bent away from leads 932 and 934 towards a central body portion 906*b* which is bent approximately 180 degrees so that a third body portion 906*c* extends substantially parallel to, and spaced from, portion 906*a* back towards leads 932 and 934. Third body portion 906*c* extends to a fourth body portion 906*d* which is bent to extend substantially parallel to, and spaced from, leads 932 and 934. Head 902 extends approximately 90 degrees from body portion 906*d* towards leads 932 and 934.

The bending of body portion 906 imparts a spring-like deflectability to shorting clip 900 so that head 902 is deflectably urged to extend into gap 941 and provide shorting engagement with leads 932 and 934. The spring bias of shorting clip 900 is desirably of sufficient magnitude that the leads 932 and 934 actually limit the deflection of head 902 away from tail 904. Head 902 desirably extends underneath the free end of the plug connector shaft inserted into socket cavity 930 so as to maintain shorting connection across leads 932 and 934 while the shaft is retained therein. As the plug connector shaft does not disengage head 902, electrical shorting may be maintained until a separate connector member, such as fixed teeth 392 and 394 of connector 210 or fixed arms 446 and 448 of connector 410, are brought down to engage body portions 906*c* or 906*d* and cause head 902 to retract from shorting engagement with leads 932 and 934. Alternatively, head 902 may be disengaged by the shaft of a plug connector, such as shaft 54 of connector 10, which is formed having a cut-out portion 57 to define a recessed ledge 57*a* which disengages head 902 after proper mechanical connection between shaft 54 and socket housing 26 is assured. It is also contemplated that the plug connectors of the present invention may provide a single tooth or arm for engaging body portion 906*c–d* of shorting clip 900.

While the preferred embodiment of the present invention has been shown and described, it will be obvious in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A connector assembly comprising:

a plug connector including a housing supporting a pair of electrical terminals and a cover movably supported in overlying disposition with respect to said housing; and a socket connector including a socket body supporting a pair of conductive contacts within a cavity formed in said socket body, and an electrical shorting clip movably positioned in engagement across said contacts, said plug connector being insertably removably accommodated by said socket body cavity for establishing electrical connection between said terminals and said contacts;

said housing further including a shaft supporting said terminals and a deflectable latch wherein said plug housing is insertably removable with respect to said socket body cavity upon deflection of said latch; and a mechanical and electrical assurance button supported by said housing including a locking arm extending between said latch and said shaft and a fixed arm extendable between said shorting clip and said shaft;

wherein said button is extendable from a first position to a second position, said first position maintaining said shorting clip across said contacts of said socket and allowing said latch to be deflected towards said shaft so as to allow said shaft to be inserted into said socket cavity, and said second position wherein said fixed arm disengages said shorting clip from across said contacts of said socket and wherein said locking arm prevents deflection of said latch so as to prevent said shaft from being withdrawn through said socket opening.

2. The connector of claim 1, wherein said button and said housing include cooperating detents for discretely positioning said button in said first and second position.

3. The connector of claim 1, further comprising a ferrite component supported by said housing.

4. The connector of claim 3, further comprising a first and second wire connected to said electrical terminals and extend through said ferrite component.

5. A connector assembly of claim 1, wherein said socket includes a socket wall and said shaft and socket wall are keyed to each other to align said contacts and said connector contacts prior to establishing electrical connection thereacross.

6. A deflectable shorting clip assembly for an electrical connection, said shorting clip assembly comprising:

a socket housing including a socket housing wall defining a socket cavity said socket housing supporting a pair of contacts in said socket cavity, said contacts defining a contact gap therebetween; and an elongate planar shorting clip having a first end supported by said socket housing wall and a second end extending into said contact gap, said second end being deflectable between a first position mutually engaging said pair of contacts and a second position spaced from mutual engagement with said pair of contacts wherein said second end of said shorting clip includes first and second converging edges for abutting against said pair of contacts, and wherein said socket housing includes an inserted shorting clip wall, said first end of said shorting clip affixed to said shorting clip wall.

7. The shorting clip assembly of claim 6, wherein said shorting clip includes an elongate shorting clip body extending between said first and second ends, said shorting clip body extending from said socket housing wall into said socket cavity.

8. The shorting clip assembly of claim 7, wherein said first end of said shorting clip extends substantially parallel to said contacts.

* * * * *